US009613766B2

(12) United States Patent
Mangold

(10) Patent No.: US 9,613,766 B2
(45) Date of Patent: Apr. 4, 2017

(54) DOOR CONTACT SWITCH, ESPECIALLY FOR SWITCHGEAR CABINETS

(71) Applicant: STEGO-HOLDING GMBH, Schwaebisch Hall (DE)

(72) Inventor: Elmar Mangold, Unterschneidheim (DE)

(73) Assignee: STEGO-HOLDING GMBH, Schwäbisch Hall (DE)

( * ) Notice: Subject to any disclaimer, the term of this patent is extended or adjusted under 35 U.S.C. 154(b) by 152 days.

(21) Appl. No.: 14/442,447

(22) PCT Filed: Nov. 13, 2013

(86) PCT No.: PCT/EP2013/073669

§ 371 (c)(1),
(2) Date: May 13, 2015

(87) PCT Pub. No.: WO2014/076106

PCT Pub. Date: May 22, 2014

(65) Prior Publication Data

US 2016/0042883 A1 Feb. 11, 2016

(30) Foreign Application Priority Data

Nov. 13, 2012 (DE) ..... 10 2012 110 900
Jan. 2, 2013 (DE) ..... 10 2013 100 022
(Continued)

(51) Int. Cl.
*H01H 35/00* (2006.01)
*H01H 3/16* (2006.01)
(Continued)

(52) U.S. Cl.
CPC ..... *H01H 3/161* (2013.01); *H01H 9/0207* (2013.01); *H01H 13/183* (2013.01)

(58) Field of Classification Search
CPC .... H01H 3/161; H01H 9/0207; H01H 13/183; H01H 13/186; H01H 21/282; H01H 9/226
(Continued)

(56) References Cited

U.S. PATENT DOCUMENTS 5,246,258 A * 9/1993 Kerschenbaum ... E05B 47/0002 292/144
5,432,309 A * 7/1995 Takeuchi ..... F16P 3/10 200/334
(Continued)

FOREIGN PATENT DOCUMENTS

CN 2003132756 A 5/2003
CN 201160033 Y 12/2009
(Continued)

OTHER PUBLICATIONS

Office Action issued Aug. 15, 2016 in related Chinese application 201380058065.5.
(Continued)

*Primary Examiner* — Kyung Lee
(74) *Attorney, Agent, or Firm* — Hassan Abbas Shakir Katten Muchin Rosenman LLP

(57) ABSTRACT

The invention relates to a door contact switch, especially for a switchgear cabinet, having a switching piece, a baseplate and a switch housing accommodating the switching piece, the switch housing being movably mounted relative to the baseplate. At least one edge of the baseplate has at least one baseplate snap-in device and the switch housing has at least one switch housing snap-in device such that the baseplate can be locked with the switch housing in at least two different positions.

16 Claims, 9 Drawing Sheets

(30) Foreign Application Priority Data

Apr. 5, 2013 (DE) ..... 10 2013 103 437
Apr. 8, 2013 (DE) ..... 10 2013 103 451

(51) Int. Cl.
*H01H 13/18* (2006.01)
*H01H 9/02* (2006.01)

(58) Field of Classification Search
USPC ..... 200/61.62
See application file for complete search history.

(56) References Cited

U.S. PATENT DOCUMENTS

| | | | | |
|---|---|---|---|---|
| D392,257 | S | 3/1998 | Lecheler et al. | |
| D425,017 | S | 5/2000 | Leung | |
| 6,376,786 | B1 * | 4/2002 | Ishibashi | H01H 3/122 200/61.62 |
| 6,881,912 | B2 * | 4/2005 | Kobayashi | E05B 81/16 200/332.1 |
| 7,154,058 | B2 | 12/2006 | Kim et al. | |
| D573,985 | S | 7/2008 | Jeong et al. | |
| D631,859 | S | 2/2011 | Wang | |
| D700,146 | S | 2/2014 | Becker | |
| 2002/0056998 | A1 * | 5/2002 | Cho | D06F 37/42 292/229 |
| 2007/0103887 | A1 | 5/2007 | Bleier et al. | |
| 2010/0276267 | A1 | 11/2010 | King | |

FOREIGN PATENT DOCUMENTS

| | | | |
|---|---|---|---|
| DE | 1 965 803 | U | 8/1967 |
| DE | 33 06 208 | A1 | 8/1984 |
| DE | 86 29 944 | U1 | 1/1987 |
| DE | 92 05 151 | U1 | 8/1992 |
| DE | 102 44 371 | C1 | 11/2003 |
| DE | 10 2010 046 752 | A1 | 3/2012 |
| EP | 2 045 520 | A2 | 4/2009 |
| EP | 2 045 520 | A3 | 8/2010 |
| FR | 2 842 492 | A1 | 1/2004 |
| JP | 2003132756 | A | 5/2003 |
| WO | 2005071793 | A1 | 8/2005 |

OTHER PUBLICATIONS

International Search Report dated Apr. 3, 2014, from the corresponding PCT/EP2013/073669.

Examination Report dated Aug. 10, 2013, from the corresponding DE 10 2013 103 451.9.

Office Action dated Nov. 5, 2014, from the corresponding Design U.S. Appl. No. 29/472,511.

Notice of Allowance dated Apr. 17, 2015, from the corresponding Design U.S. Appl. No. 29/472,511.

Written Opinion for Corresponding Application PCT/EP2013/073669 in English, mailing date of May 19, 2015.

* cited by examiner

DOOR CONTACT SWITCH, ESPECIALLY FOR SWITCHGEAR CABINETS

BACKGROUND OF THE INVENTION

1. Field of the Invention

The invention relates to a door contact switch, in particular for switchgear cabinets, comprising a switch plunger, a baseplate and a switch housing for accommodating the switch plunger, the switch housing being displaceably mounted relative to the baseplate.

2. Discussion of the Related Art

Door contact switches are used to actuate interior lighting and for other switching functions, in particular within switchgear cabinets. Door contact switches are known that have a baseplate and a housing displaceable relative to the baseplate for accommodating a switch plunger. The switch housing can be screwed to the baseplate to set a certain relative position. To this end bores are provided in the baseplate and switch housing, in which bores a screw can be accommodated. The distance of the switch plunger can be adjusted by a measure of this type. On the whole, however, adjustments of this type are found to be relatively complex.

The object of the invention is therefore to propose a door contact switch in which the position of a switch housing relative to a baseplate can be adjusted using simple means.

This object is achieved by a door contact switch as claimed in claim 1.

In particular the object is achieved by a door contact switch, preferably for switchgear cabinets, comprising a switch plunger, a baseplate and a housing for accommodating the switch plunger, the switch housing being displaceably mounted relative to the baseplate, at least one edge of the baseplate having at least one baseplate detent device and the switch housing having at least one switch housing detent device such that the baseplate can be latched to the switch housing in at least two different positions.

A core concept of the invention lies in providing a baseplate detent device on an edge of the baseplate. The adjustment of a relative position between baseplate and switch housing can thus be set in an extremely simple manner. The baseplate detent device is on the one hand relatively easily accessible, and on the other hand the locking in a certain position can be provided quickly and in an uncomplicated manner due to the provision of a detent device.

The term "baseplate" generally is not intended to rule out the fact that the baseplate has protrusions, which, where appropriate, also protrude with respect to an upper side and/or underside of the baseplate. However, it is conceivable that the baseplate is completely planar, i.e. has no protrusions protruding upwardly or downwardly. A maximum extension of the baseplate in a height direction is preferably at most 10% of a maximum extension in a lateral (perpendicular to the height direction) direction (for example length and/or width direction). An "edge" is preferably an intermediate region between an outer side and an inner side of the baseplate, an outer side being understood to be a side facing away from the switch housing and an inner side being understood to be a side of the baseplate facing toward the switch housing.

At least two baseplate detent devices are preferably provided, which are arranged on opposite edges. With an arrangement of this type the latching can be established and released particularly easily (manually). A setting of the relative position between baseplate and switch housing is further simplified. In particular a latching or cancellation thereof using just one hand is enabled particularly easily.

In one specific embodiment at least one baseplate detent device can have at least one baseplate detent tooth, more preferably at least two baseplate detent teeth. The at least one baseplate detent tooth can be directed inwardly. Alternatively or additionally, at least one switch housing detent device has at least one detent tooth or at least two detent teeth. The switch housing detent devices are preferably directed outwardly. Alternatively, it is conceivable that the baseplate detent teeth are directed outwardly and/or the switch housing detent teeth are directed outwardly. Due to the provision of detent teeth of this kind, the locking in a certain alternative position is further simplified. If the baseplate detent teeth are directed inwardly, the locking can be established in a simple manner in that the baseplate detent device is pressed inwardly, for example by applying pressure using thumbs and/or another finger of the operating person. On the whole, an adjustment of the relative position is further simplified.

In one specific embodiment at least one baseplate detent device has at least one pivotable detent lever. Alternatively or additionally, the switch housing may also have at least one pivotable detent lever. A pivotable detent lever of the baseplate detent device further facilitates the establishment and cancellation of the latching in order to set the relative position. At least one baseplate detent tooth or at least two baseplate detent teeth is/are preferably arranged on an inner side of the detent lever. If the detent lever is pivoted inwardly the latching is established. If the detent lever is pivoted outwardly the latching is cancelled. A pivot "inwardly" is to be understood in particular to mean a pivot in the direction of a center of the baseplate (for example a center axis or central axis of symmetry). Accordingly, an inner side of the detent lever points in the direction of a center of the baseplate. In one specific embodiment the inner side of the detent lever stands perpendicular to an inner side of the baseplate. It is particularly preferred that the at least one detent tooth or the at least two detent teeth of the detent lever does/do not extend over the entire width of the detent lever, but only over at most 80% or at most 60%. In the latched state the locking can thus be cancelled particularly easily in that the operating person intervenes in a gap between detent lever and switch housing or another component of the baseplate, such that the detent lever can be pressed outwardly to release the locking. In the locked state the distance between detent lever and switch housing or an adjacent component of the baseplate may be at least 2 mm, preferably at least 4 mm.

In a preferred embodiment the baseplate has at least one slide rail, in which (or on which) the switch housing can slide. At least one baseplate detent device is preferably arranged in the region of (within) the slide rail. By means of a slide rail of this type the relative position or a pre-positioning can be set relatively easily. Since the baseplate detent device is arranged in the region of or within the slide rail, the structure is made thinner and is simplified on the whole, which reduces the structural outlay.

The baseplate may have at least one baseplate positioning device, in particular at least one baseplate positioning recess (and/or baseplate positioning protrusion), which cooperates with at least one corresponding switch housing positioning device, in particular at least one switch housing positioning protrusion (and/or switch housing positioning recess), such that a predetermined position can be set prior to a latching by the detent devices. The advantage of a baseplate positioning device provided in such a way (in addition to the detent devices) and/or switch housing positioning device lies in that a certain position can be defined using simple means, in which position it is ensured that the latching is enabled without friction.

In accordance with a general concept the at least one baseplate detent device and also the at least one switch housing detent device can be formed in such a way that a latching is enabled by applying pressure inwardly and/or a cancellation of the latching is enabled by applying pressure outwardly. A simple establishment and cancellation of the latching is thus enabled.

In one specific embodiment at least one baseplate detent device protrudes from an inner side of the baseplate (i.e. a side facing toward the switch housing) in the direction of the switch housing. By means of a protruding formation of this type, the cancellation of the latching is further simplified, which facilitates the handling of the detent device on the whole.

In principle it is preferred when the movement path of the plunger is coordinated with the detent distances of detent teeth. A higher number of switch housing detent teeth (latchings) result in an improved fine adjustment and/or a longer adjustment path. In principle the latching can be implemented in any fineness. Finer detent distances may be advantageous in principle depending on further plunger functions.

Furthermore, the door contact switch and in particular the switch housing may have a strain relief device on a side facing away from the switch plunger so as to prevent cables from being torn off or out from the switch housing. It is particularly advantageous when the strain relief device has a rocker element, which is mounted displaceably along an axis and pivotably about a pivot point. In this way the strain relief device is quasi self-adjustable and can be used with cables of a wide range of thicknesses and in various combinations. The rocker element for this purpose preferably has a through-opening, through which a fastening means is passed. The rocker element may also have at least two rocker parts for fastening cables, said rocker parts being arranged symmetrically with respect to a longitudinal axis of the fastening means and having a convex rounded portion facing the cables in the state of use. Furthermore the at least two rocker parts may each have a guide groove, with which guide pins of a main body engage. The pivot motion of the rocker element can thus be executed in an optimal manner.

In order to achieve the above-mentioned object, a door contact switch in particular according to the preamble of claim 1 and also in particular as claimed in one of claims 1 to 8 is also proposed, which has a pivotably mounted strain relief device.

Further embodiments will emerge from the dependent claims.

BRIEF DESCRIPTION OF THE DRAWINGS

The invention will be explained in greater detail hereinafter on the basis of an exemplary embodiment with reference to the accompanying, schematic drawings, in which.

DETAILED DESCRIPTION OF THE INVENTION

The same reference signs will be used in the following description for like and identically acting parts.

Figure 1:
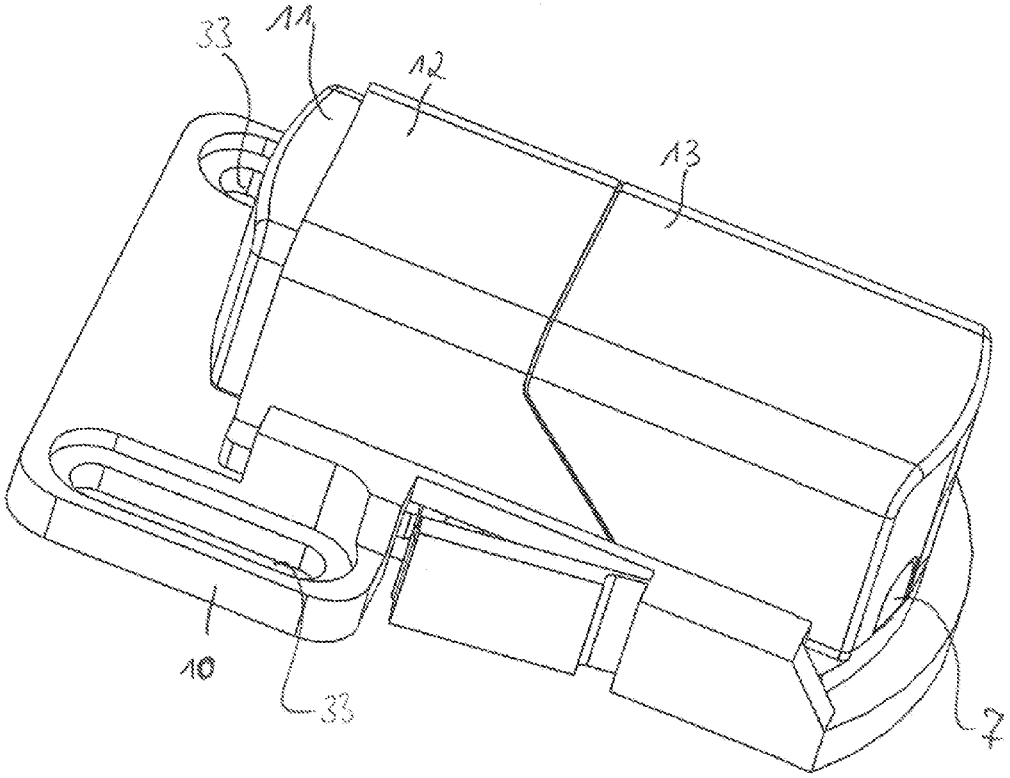
FIG. 1 shows a schematic oblique view of a door contact switch.
Figure 2:
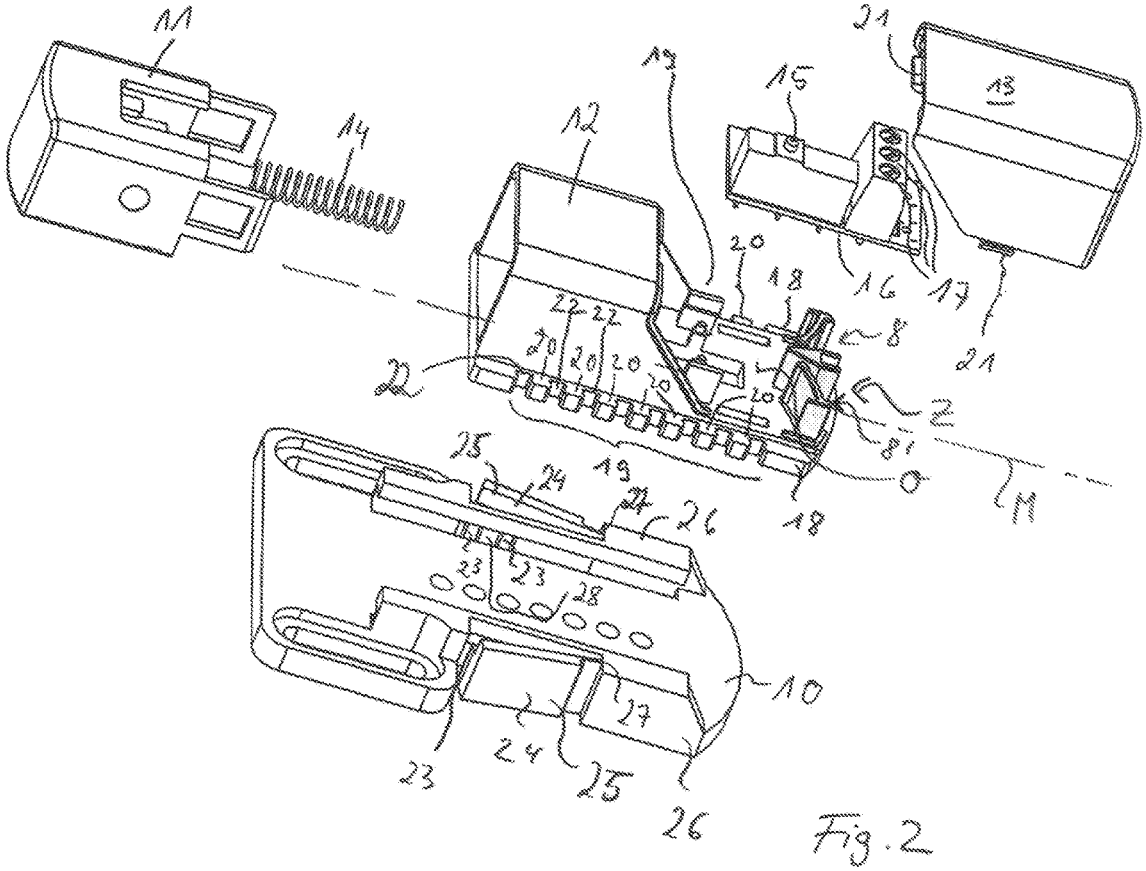
FIG. 2 shows a schematic exploded illustration of the door contact switch.

FIG. 1 shows a door contact switch according to a first embodiment in a schematic oblique view. The door contact switch comprises a baseplate 10, a switch plunger 11, a switch housing 12 and a cover 13. FIG. 2 shows a schematic exploded view of the door contact switch. The switch plunger 11 is mounted in the switch housing 12, the switch plunger 11 being loaded by a spring 14. The spring 14 pushes the switch plunger 11 away from the switch housing 12 (when no counterforce is present, for example on account of a closed door). The switch plunger 11 moves a proximity switch (snap-action switch) 15 of a printed circuit board 16 over a chamfered run-on surface (not shown). A signal is thus triggered, which can be further processed (for example so as to interrupt an electric circuit for a lighting system) via contacts (connection terminals) 17 and one or more cables (not shown), which are fastened in the connection terminals 17. The cables are fixed with the aid of a strain relief device Z, which is mounted at an end of the switch housing 12 facing away from the switch plunger 11 on a surface O facing away from the baseplate 10. The strain relief device Z is formed here by an arrangement of flexible clamps 8 and 8' suitable for accommodating and fixing cables, said arrangement being symmetrical to a center axis M of the switch housing 12. The cables thus extend through the strain relief device Z to the connection terminals 17, where they are fastened with the aid of fastening means, usually with the aid of screws. So as to guide the cables, where possible "without deflection", through the cable feedthroughs 7 in the cover 13 to the strain relief device Z, and from there to the connection terminals 17, the aforementioned elements are arranged in succession in the direction of the center axis M of the switch housing 12.

Figure 3:
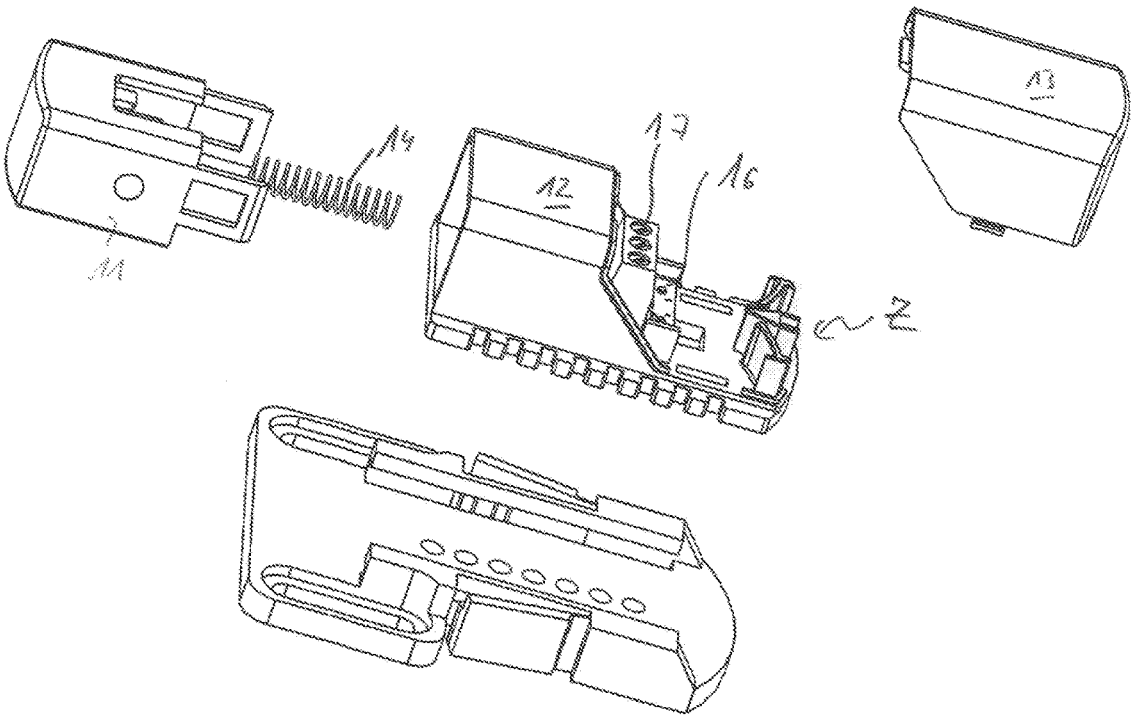
FIG. 3 shows a schematic (partial) exploded illustration of the door contact switch.

In the schematic exploded view according to FIG. 3 the printed circuit board 16 is shown in the state thereof mounted on the switch housing 12, in particular on the surface O. The housing 12 has a switch housing detent device 19 on each of its (two) switch housing edges 18. The switch housing detent devices 19 comprise a plurality of (specifically seven) switch housing detent teeth 20, which protrude outwardly, i.e. away from the corresponding switch housing edge 18. In the present exemplary embodiment the number of switch housing detent teeth 20 (specifically seven) was adapted to the function of the switch plunger or movement path thereof. With other plunger functions the number of switch housing detent teeth 20 could be increased, or finer detent distances could be provided (without necessarily increasing the number of switch housing detent teeth).

Due to the two-part design of a protective sleeve for the printed circuit board 16, specifically the switch housing 12 on the one hand and the cover 13 on the other hand, reliable protection of the operating individual is achieved, and the printed circuit board is easily accessible at the same time.

The cover is to provide sufficient protection for the operating personnel. The cable feedthroughs 7 of the cover 13 can be used together with the clamps 8 and 8' of the strain relief device Z as holders for connected lines so as to thus improve the strain relief. Here, the requirements of electrical insulation class II are met. On the whole, the operating personnel (skilled personnel) is to be protected against accidental contact as the switchgear cabinet is opened.

In order to remove the cover 13, this is provided with detent pins 21, which can be introduced into complementary recesses in the switch housing 12 (conversely, detent pins 21 for connection with recesses in the cover 13 may also be provided on the housing 12).

Switch housing recesses 22, with which baseplate detent teeth 23 of (two) baseplate detent devices 24 can engage, are provided between the switch housing detent teeth 20 of the switch housing 12. The baseplate detent devices 24 each comprise a detent lever 25, which is mounted pivotably (about a pivot axis 27) on a corresponding baseplate edge 26. In FIGS. 1-3 the detent lever 25 is in a position in which it is not latched with the switch housing detent device 19. If (in a predetermined position) the detent lever 25 is pushed inwardly in the direction of the switch housing 12, the baseplate detent teeth 23 engage with the switch housing detent teeth 20, such that a locking operation takes place.

The term "latch" in the context of the present invention thus means to lock or interlock the detent lever 25 or the baseplate detent teeth 23 and the switch housing detent teeth 20. In other words the baseplate detent teeth 23 are clipped into the switch housing recesses 22 by exertion of a force. There is thus a force-fitting connection between the baseplate detent teeth 23 and the switch housing recesses 22. The baseplate detent teeth 23 or the switch housing detent teeth 20 are preferably slightly larger than the associated openings (baseplate recesses or switch housing recesses), such that a force fit exists until the connection is released by exertion of a corresponding force.

In a preferred development the switch housing recesses 22 are undercut. Accordingly, a baseplate recess 28 is also formed in an undercut manner between the baseplate detent teeth 23.

Figure 4:
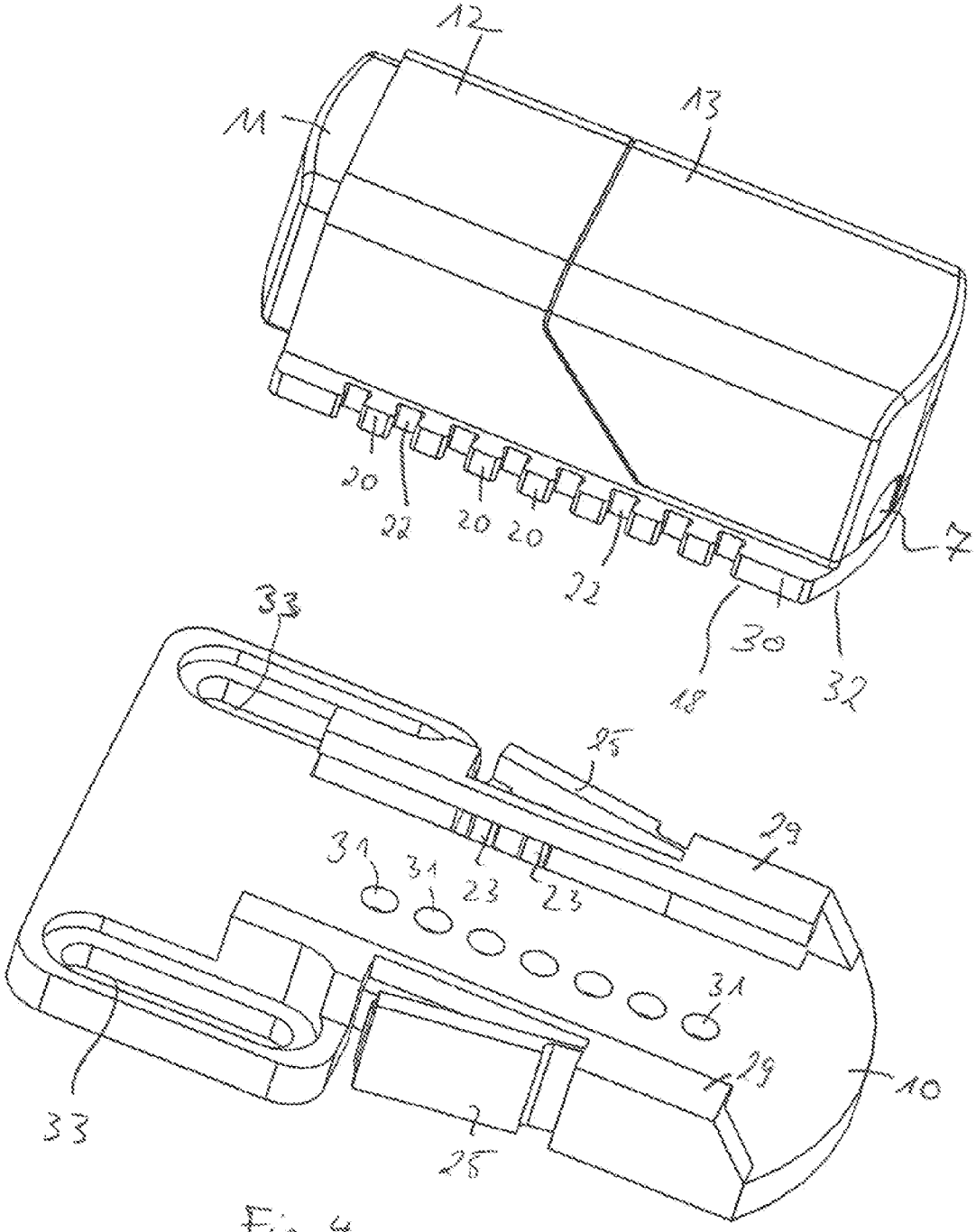
FIG. 4 shows a schematic (partial) exploded illustration of the door contact switch.

In the schematic exploded view according to FIG. 4 the baseplate 10 and, separated therefrom, a unit comprising the switch plunger 11, the switch housing 12 and the cover 13 are illustrated in an enlarged manner. The baseplate 10 comprises two rails 29, which are provided to accommodate a (elongate) protrusion 30 of the switch housing, in such a way that the protrusion 30 (which is provided on each switch housing edge 18) can slide in the rail 29. For this reason the rail 29 is U-shaped in cross section. It is conceivable to reverse the conditions, such that a U-shaped slide rail is provided on the switch housing 12, which slide rail cooperates accordingly with a protrusion provided on the baseplate. The protrusion 30 of the switch housing 12 simultaneously defines the switch housing edge 18.

A detent lever 25 is provided in the region of each rail 29 in such a way that the respective detent lever 25 forms a portion of each rail 29. The baseplate detent teeth 23 are arranged here on a bottom of the U-shaped cross-section of the corresponding slide rail 29.

The baseplate 10 comprises baseplate positioning devices 31 (in the form of apertures or bores). At least one protrusion (not shown in the Figures) provided on an underside 32 of the switch housing 12 can engage with these baseplate positioning devices 31, such that a pre-positioning can be performed before the actual latching is performed by exertion of pressure on the detent levers 25. The number (as in the present case) of baseplate positioning devices preferably corresponds to the number of detent teeth 20 of the switch housing 12. However, the respective numbers can also deviate from one another.

The baseplate 10 has holes (slots) 33 in order to assemble the baseplate within a device (for example a switchgear cabinet). Due to the design as slots, the positioning can be fashioned in a more variable manner. The assembly and adjustment of the door contact switch will be described hereinafter. In principle, the switch plunger 11 is more easily accessible than the baseplate 10 having the baseplate positioning devices 31, which means that when pressure is applied to the switch plunger, said switch plunger is firstly moved, and the baseplate 10 retains the position relative to the switch housing 12. The door contact switch is initially fastened via the holes 33 (slots). The detent position of the baseplate 10 is right to the front at this moment in time (the protrusion, not shown, on the underside 32 of the half housing 12 rests in the baseplate positioning device 31 closest to the stop of the plunger 11). When the door is first closed (in order to adjust the door contact switch), the switch plunger 11, which is more easily accessible, is first moved, and the baseplate 10 is then moved (after completion of the movement of the plunger) relative to the switch housing 12 as far as an end position. In this end position the setting is locked via the detent levers 25.

Figure 5:
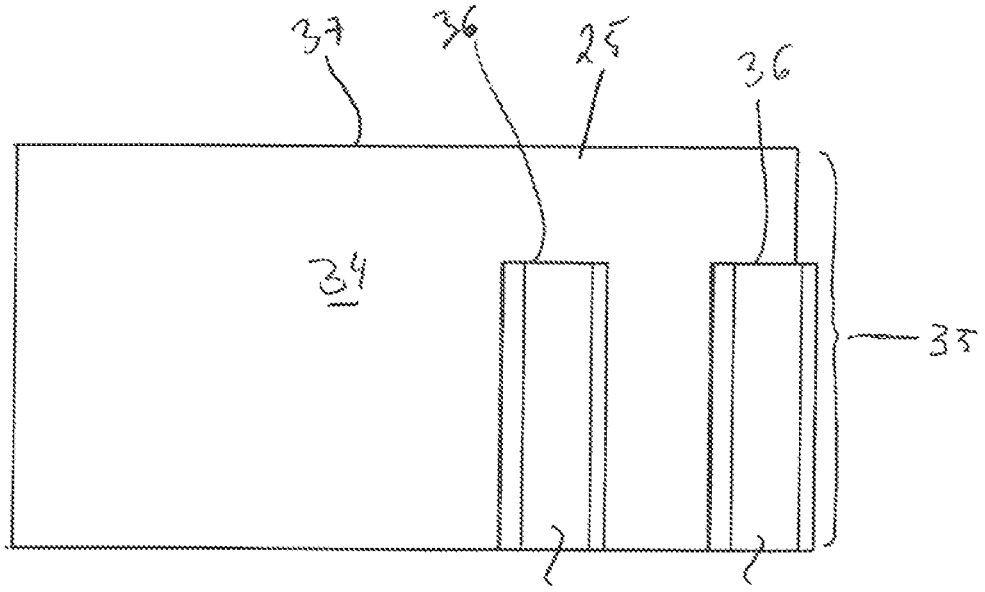
FIG. 5 shows a detent lever.

In FIG. 5 the detent lever 25 (lower detent lever in FIG. 4) is illustrated in an enlarged side view, specifically on an inner side 34 of the detent lever 25. As can be deduced from FIG. 5, the detent teeth 23 do not extend over the entire width 35 of the detent lever 25. In particular one end 36, which points in the direction of the switch housing 12, is distanced from a switch lever edge 37, which points in the direction of the switch housing 12. The switch lever 25 can thus be pushed away particularly easily from the rail 29 of the baseplate 10 in order to cancel the locking. On the whole, the baseplate detent teeth 23 are longer (in a vertical direction in relation to the baseplate 10) than the detent teeth 20 of the switch housing. A reliable latching is thus ensured.

Figure 6:
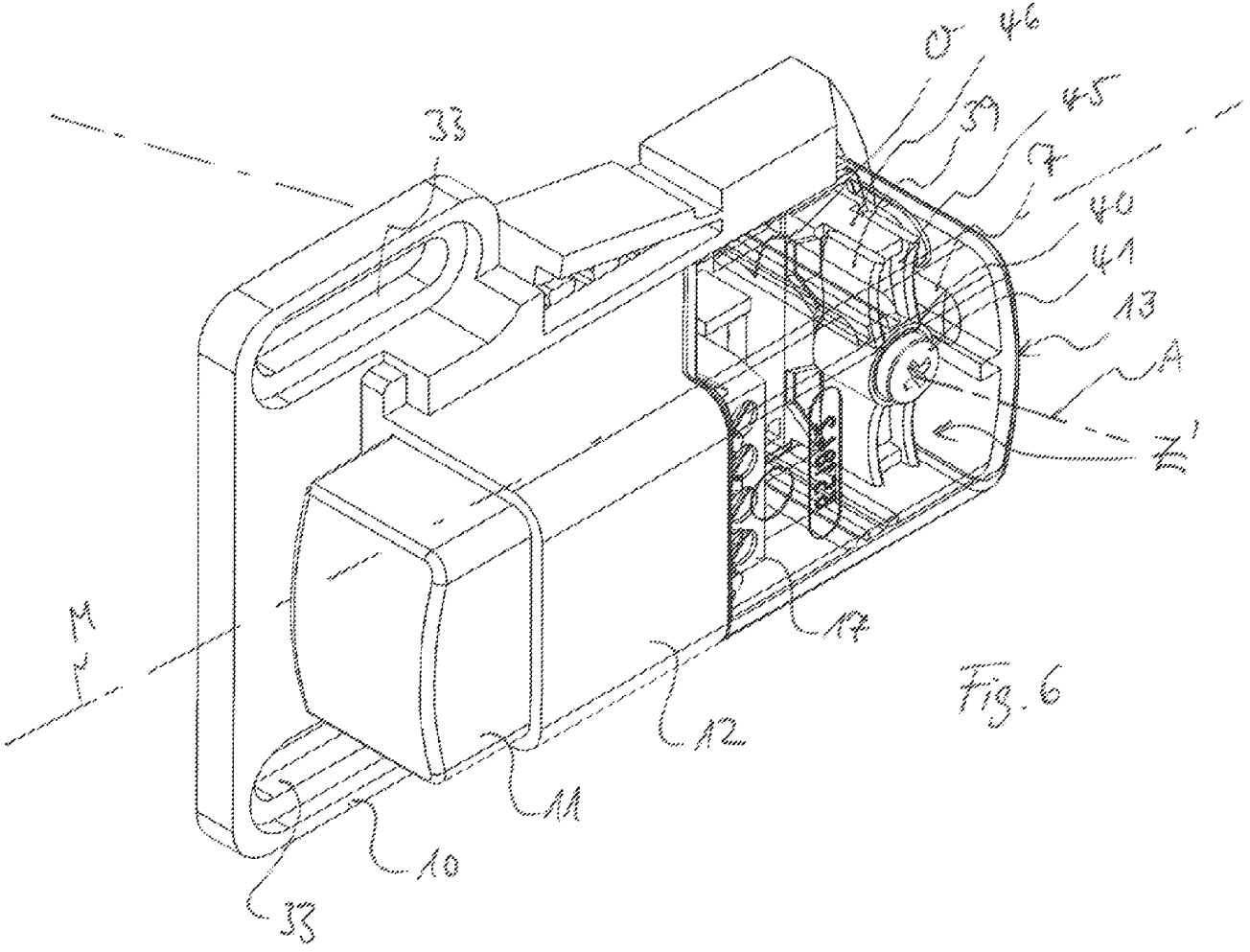
FIG. 6 shows a perspective illustration of a further embodiment of a door contact switch.
Figure 7:
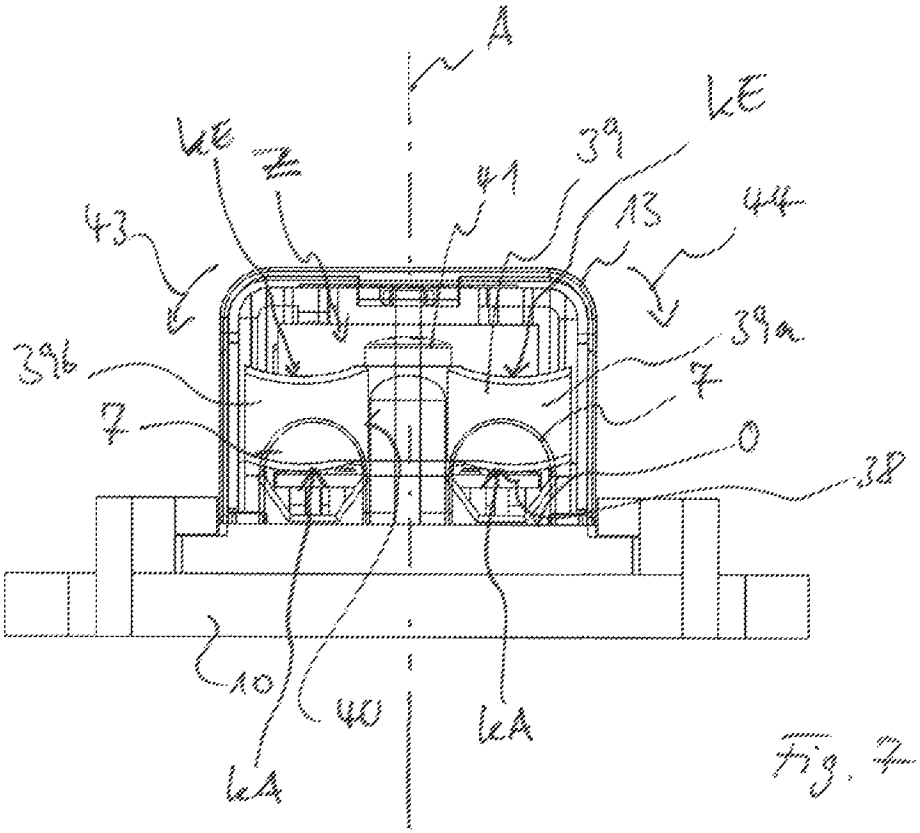
FIG. 7 shows a front-face view of the door contact switch according to FIG. 6.
Figure 8:
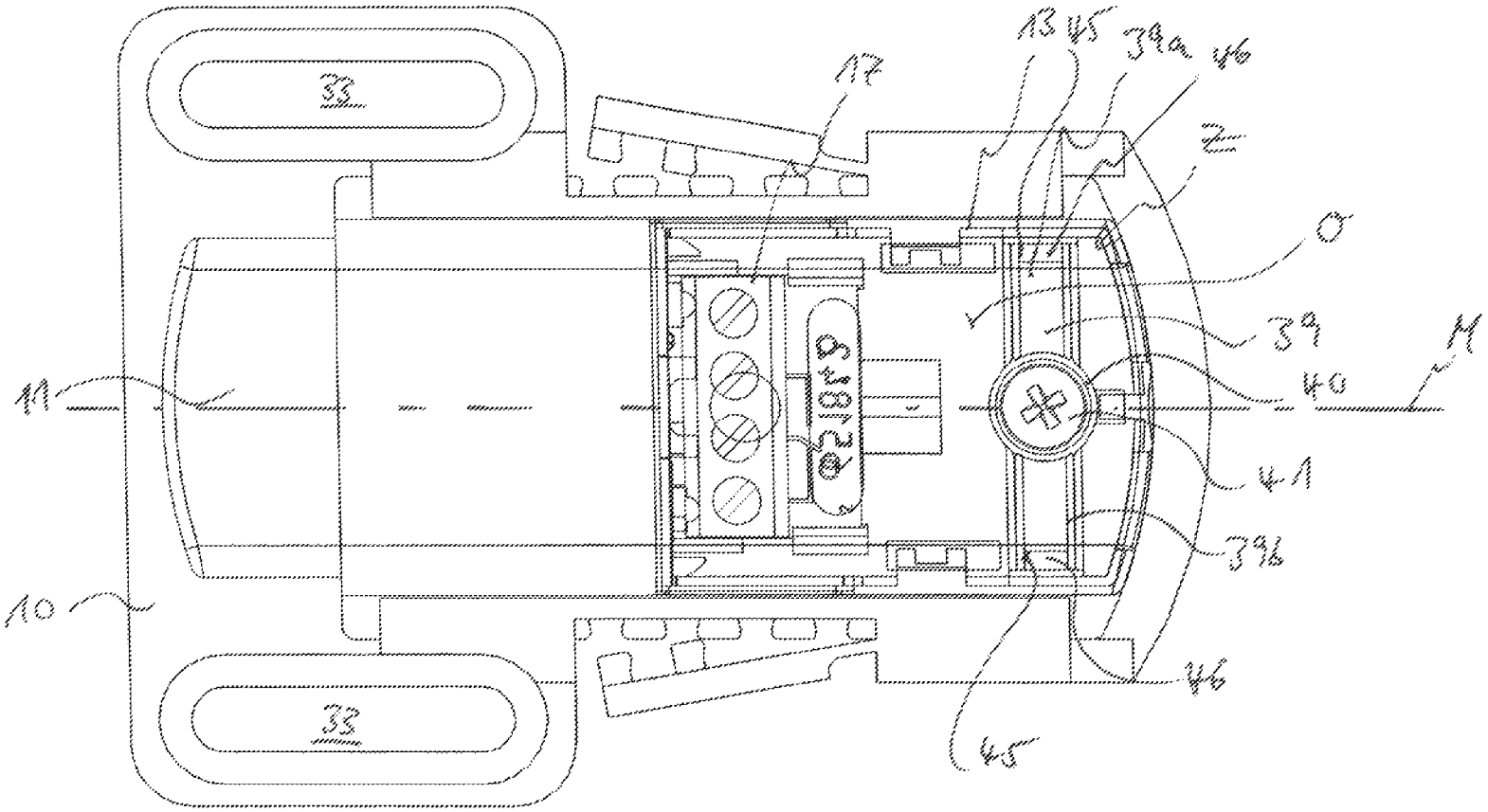
FIG. 8 shows a plan view of the door contact switch according to FIG. 6.
Figure 9:
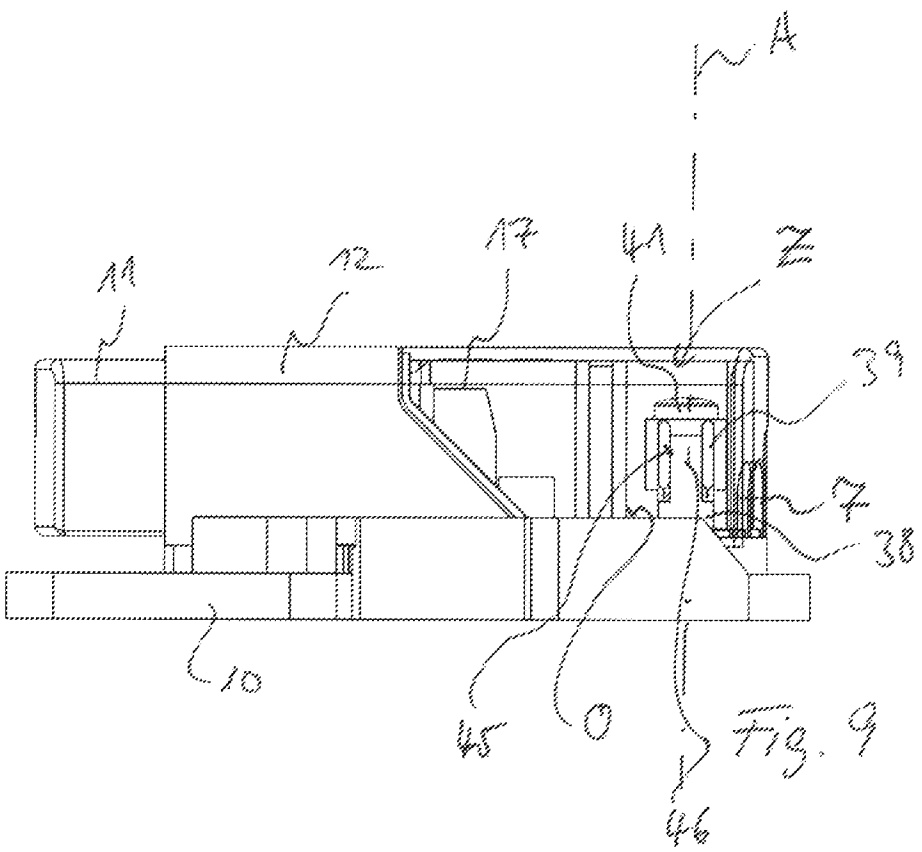
FIG. 9 shows a side illustration of the door contact switch according to FIG. 6.

FIGS. 6-9 show a further door contact switch according to the invention that has a modified strain relief device Z'. The strain relief device Z' is again mounted on a surface O of the switch housing 12 in a region and in particular at an end of the switch housing 12 opposite the switch plunger 11. In FIG. 6 the cover 13 is illustrated transparently such that the arrangement of the strain relief device Z' below the cover 13 can be seen. It is clear that the strain relief device Z' is preferably arranged, as illustrated in the figures, symmetrically with respect to an axis A perpendicular to the center axis M of the switch housing 12.

The strain relief device Z' may comprise a main body 38, which can be connected to the surface O of the switch housing 12 or can be formed in one piece therewith. The main body may thus be part of the switch housing 12. The main body 38 is preferably symmetrical with respect to the axis A and is used to support the cables or lines in the strain relief device Z'.

The strain relief device Z' further comprises a rocker element 39, which has a central through-opening 40 for accommodating a fastening means 41, in particular a screw. The fastening means 41 passes through the through-opening 40 and engages with a corresponding opening in the main body 38. In this way the fastening means 41 can be displaced along the axis A into the main body 38, in particular screwed in, whereby the rocker element 39 is displaced in the direction of the main body 38. The longitudinal axis of the fastening means 41 preferably coincides with the axis A.

The rocker element 39 is substantially elongate and extends in a direction transversely to the center axis M of the switch housing 12, i.e. in the width direction of the switch housing. Rocker parts 39*a* and 39*b*, which are rounded on a side facing toward the main body 38 and in a direction toward the main body 38, extend on either side of the through-opening 40. The space between the rocker parts 39*a*, 39*b* and the main body 38 is used to accommodate, mount and fix cables that pass through the cable feedthroughs 7 in the cover 13 to the strain relief device Z'. These may be cables or multi-core cables in a cable sheath (lines) of a wide range of thicknesses. The cable feedthroughs 7 and the strain relief device Z' are accordingly arranged relative to one another such that the spaces between the rocker parts 39*a*, 39*b* and the main body 38 are in line with the cable feedthroughs 7. In the present example two cable feedthroughs 7 are provided, which are substantially in line with two rocker parts 39*a* and 39*b*. At least two cables or lines can thus be introduced into the door contact switch. In the fixed state, i.e. in the "strain-relieved" state, the fastening means 41 is tightened, such that the rocker parts 39*a* and 39*b* rest on the cable sheath.

The strain relief device Z' is particularly advantageous because the rocker element 39 is additionally mounted pivotably about a pivot point, which lies on the longitudinal axis of the fastening means 41 and therefore on the axis A. In particular the rocker element 39 is mounted pivotably in a plane (hereinafter: "pivot plane"), which is oriented perpendicularly on the surface O of the switch housing 12 and perpendicularly to the center axis M of the switch housing 12. It is clear on the basis of FIG. 7 that the rocker element, in the case of a released fastening means, is mounted pivotably in the direction of the arrows 43 and 44 and can thus "rock" so to speak. This results in the advantage that cables of quite different thickness can be introduced into the switch housing 12 and fixed in the strain relief device Z', since the space between the rocker parts 39*a*, 39*b* and the main body 39 adapts individually to the respective cable. In other words, when the rocker element 39 is pivoted for example in the direction of the arrow 43, the space between the rocker part 39*a* and the main body 38 becomes smaller, such that a thinner cable can be mounted therein and fixed. By way of example, the rocker part 39*a* can thus cooperate with a thin cable, whereas the other rocker part 39*b* cooperates with a very thick cable, for example of 0.8-1.00 cm. It goes without saying that the strain relief device Z' can also be used in order to fasten two identically thick cables or two identically thin cables. A rocking or pivoting motion is not necessary in this case.

In order to provide the pivotable mounting of the rocker element 39, the through-opening 40 made therein must be formed accordingly. The through-opening 40 thus preferably has a diameter (at least in the pivot direction 43, 44) larger than the fastening means 41 such that a pivot motion can be executed without problems, within certain limits. By way of example, a conical design of the through-opening 40 is also conceivable. The pivot motion of the rocker element 39 in the pivot plane is self-adjusting depending on the used cables. Due to the convex rounded portion kA of the rocker parts 39*a*, 39*b* in the region of the cables, an optimal adaptation and bearing of the rocker parts to/against the cable is additionally made possible, wherein damage to the cables is avoided. Furthermore, the rocker element 39 comprises a concave indentation kE opposite the convex rounded portion (in the direction of the axis A). In other words each rocker part 39*a*, 39*b*, as considered in the direction of the axis A, has a (arcuate) depression on one side and a (arcuate) protrusion on the opposite side. The rocker parts 39*a*, 39*b* are thus each curved as considered on the whole, the radius of curvature of the concave indentation kE preferably corresponding to the radius of curvature of the convex rounded portion kA. The thickness of each of the curved surfaces in the direction of the center axis M is preferably such that a sufficient bearing surface is provided for reliable strain relief of the cables. In the assembly state shown in FIG. 7 the rocker element 39 is arranged relative to the main body 38 in such a way that the convex rounded portion faces toward a cable resting on the main body 38. However, the rocker element 39 can rotate through 180° in the direction of the arrows 43 or 44, such that the concave indentation kE faces toward a cable in a second assembly state of the rocker element 39. The rocker element 39 can be transferred easily from one assembly state into the other assembly state by removing the fastening means 41.

The concave indentation kE is used to accommodate particularly thick cables, which find more space in the indentation, whereas the convex rounded portion ensures an optimal fixing for thinner cables. It is additionally conceivable to form the rocker parts 39*a*, 39*b* not in a mirror image with respect to the axis A, but centrally symmetrically. In this case one rocker part 39*a* may therefore have, for example, an indentation facing toward the main body 38 for a thicker cable, and the other rocker part 39*b* may have in the same assembly state a convex rounded portion facing the main body 38 for a thinner cable. It is also conceivable in principle to provide a number of rounded portions and/or a number of indentations and/or combined indentations and rounded portions side by side, such that a number of individual, thinner and/or thicker cables, i.e. in particular more than two, can be guided through the strain relief device Z'. It is consequently conceivable in particular to fasten more than one cable or one line by means of a rocker part 39*a* or 39*b*.

In order to guide the pivot motion in the pivot plane, the rocker parts 39*a*, 39*b* on the side faces thereof facing away from the through-opening 40 each have a guide groove 45, with which guide pins 46 of the main body 38 engage. Here, the guide groove 45 must be deep enough that a pivot motion is still easily possible. The guide pins 46 are preferably connected in one piece to the main body 39 and in particular in one piece to the switch housing 12. Provided the fastening means 41 is removed far enough from the main body 38, in particular is unscrewed, the rocker element 39 can additionally rotate through 180° about the axis A. In contrast to the strain relief device Z shown in FIGS. 1-5, the strain relief device Z' according to FIGS. 1-6 thus has the advantage that a strain relief of cables no longer has to be achieved by the cooperation of the cable feedthroughs 7 in the cover 13 and the clamps 8, 8', which means that the thickness of the usable cables is fixed to the diameter of the cable feedthroughs 7 and the maximum thickness that can be accommodated by the clamps 8, 8'. In addition, only two cables with identical thickness can be accommodated here. By contrast, with the strain relief device Z' shown in FIGS. 1-6, cables of any thickness and in any combination can be introduced through the cover 13 into the switch housing 12. Due to the rocking or pivotable mounting of the rocker element 39, the strain relief device Z' can be easily adapted to the different diameters of the used cables. The strain relief device Z' is therefore particularly advantageous on the whole.

LIST OF REFERENCE SIGNS

7 cable feedthroughs
8, 8' clamps

10 baseplate
11 switch plunger
12 switch housing
13 cover
14 spring
15 proximity switch
16 printed circuit board
17 contact (connection terminal)
18 switch housing edge
19 switch housing detent device
20 switch housing detent tooth
21 detent pin
22 switch housing recess
23 baseplate detent tooth
24 baseplate detent device
25 detent lever
26 baseplate edge
27 pivot axis
28 baseplate recess
29 rail (slide rail)
30 protrusion
31 baseplate positioning device
32 underside (of the switch housing)
33 hole
34 inner side (of the detent lever)
35 width (of the detent lever)
36 end (of the baseplate detent tooth)
37 detent lever edge
38 main body
39 rocker element
39*a*, 39*b* rocker parts
40 through-opening
41 fastening means
43 arrow (pivot direction)
44 arrow (pivot direction)
45 guide groove
46 guide pin
Z, Z' strain relief device
O surface
M center axis
A axis
kA convex rounded portion
kE concave indentation

What is claimed is:

1. A door contact switch comprising:
a switch plunger;
a baseplate; and
a switch housing for accommodating the switch plunger, the switch housing being displaceably mounted relative to the baseplate;
wherein at least one edge has at least one baseplate detent device and the switch housing has at least one switch housing detent device for latching the baseplate to the switch housing in at least two different positions.

2. The door contact switch as claimed in claim 1,
wherein two baseplate detent devices are provided, baseplate detente devices are arranged on opposite baseplate edges.

3. The door contact switch as claimed in claim 2,
wherein at least one baseplate detent device has at least one baseplate detent tooth directed inwardly or at least one switch housing detent device having at least one switch housing detent tooth directed outwardly.

4. The door contact switch as claimed claim 1,
wherein at least one baseplate detent device has at least one pivotable detent lever.

5. The door contact switch as claimed in claim 1,
wherein the baseplate has at least one slide rail in which the switch housing can slide, at least one baseplate detent device being arranged in a region of the slide rail.

6. The door contact switch as claimed in claim
wherein the baseplate has at least one baseplate positioning device cooperating with at least one corresponding switch housing positioning device for setting a predetermined position prior to latching.

7. The door contact switch as claimed in claim 1,
wherein the at least one baseplate detent device and also and the at least one switch housing detent device latch by applying pressure inwardly or cancel latching by applying pressure outwardly.

8. The door contact switch as claimed in claim 1,
wherein at least one baseplate detent device protrudes from an inner side of the baseplate in the direction of the switch housing.

9. The door contact switch as claimed in claim 1,
wherein the switch housing has a strain relief device on a side facing away from the switch plunger (11).

10. The door contact switch as claimed in claim 9,
wherein the strain relief device has a rocker element, which is mounted displaceably along an axis and is mounted pivotably about a pivot axis.

11. The door contact switch as claimed in claim 10,
wherein the rocker element has a through-opening through which a fastening means for fastening in a main body is passed.

12. The door contact switch as claimed in claim 10,
wherein the rocker element has at least two rocker parts for fastening cables, the rocker parts being arranged symmetrically with respect to a longitudinal axis of the fastening means and having a convex rounded portion facing toward the cables in the state of use.

13. The door contact switch as claimed in claim 12,
wherein the at least two rocker parts each have a guide groove with which guide pins engage.

14. The door contact switch as claimed in claim 12,
wherein the rocker parts each have at least one convex rounded portion and at least one opposite concave indentation.

15. The door contact switch as claimed in claim 12, further comprising a pivotably mounted strain relief device.

16. The door contact switch as claimed in claim 1,
wherein the baseplate has at least one baseplate positioning recess cooperating with at least one corresponding switch housing positioning protrusion for setting a predetermined position prior to latching.

* * * * *